United States Patent [19]

Stillie

[11] 4,427,861

[45] Jan. 24, 1984

[54] MEANS FOR MOUNTING MEMBRANE SWITCHES TO CATHODE RAY TUBES

[75] Inventor: Donald G. Stillie, Winston-Salem, N.C.

[73] Assignee: AMP Incorporated, Harrisburg, Pa.

[21] Appl. No.: 452,586

[22] Filed: Dec. 23, 1982

[51] Int. Cl.[3] ..... H01H 9/08

[52] U.S. Cl. ..... 200/159 B; 340/365 VL; 340/712; 340/815.2

[58] Field of Search ..... 340/712, 365 UL, 365 C, 340/725, 815.2; 200/159 B, 5 A, 294

[56] References Cited

U.S. PATENT DOCUMENTS

| | | | |
|---|---|---|---|
| 3,560,675 | 2/1971 | Krakinowski | 340/712 |
| 3,757,322 | 9/1973 | Barkan et al. | 340/712 |
| 4,085,302 | 4/1978 | Zenk et al. | 200/159 B |
| 4,346,376 | 8/1982 | Mallos | 340/712 |
| 4,375,018 | 2/1983 | Petersen | 200/5 A |

*Primary Examiner*—John W. Shepperd
*Attorney, Agent, or Firm*—Katherine A. Nelson

[57] ABSTRACT

A membrane switch having mounting means for mounting the switch to a cathode ray tube (CRT) is disclosed. The mounting means is comprised of extensions protruding from the perimeter of the membrane switch, each extension having thereon a patch of a coupled fastening assembly. The fastening assembly is comprised of two separable parts, the inner surfaces of which have a very large number of closely spaced hooking elements of the hook and loop type that engage with each other when the two parts are pressed together. When the switch is aligned against the CRT, the extensions wrap around the perimeter of the CRT. The outer surface of the fastening assembly can then be attached to the sides of the CRT. The mounting means disclosed herein holds the switch securely to the face of the CRT and at the same time permits easy realignment if the switch becomes distorted during use.

14 Claims, 5 Drawing Figures

Fig. 3
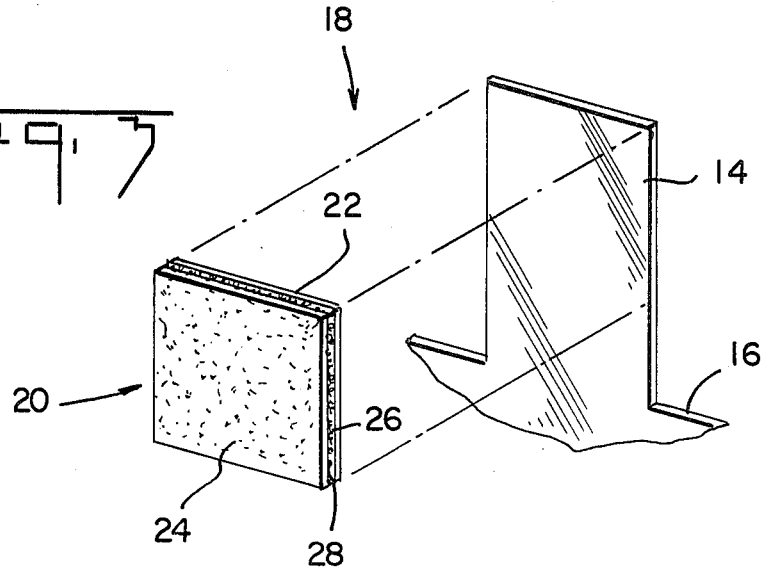
Fig. 4
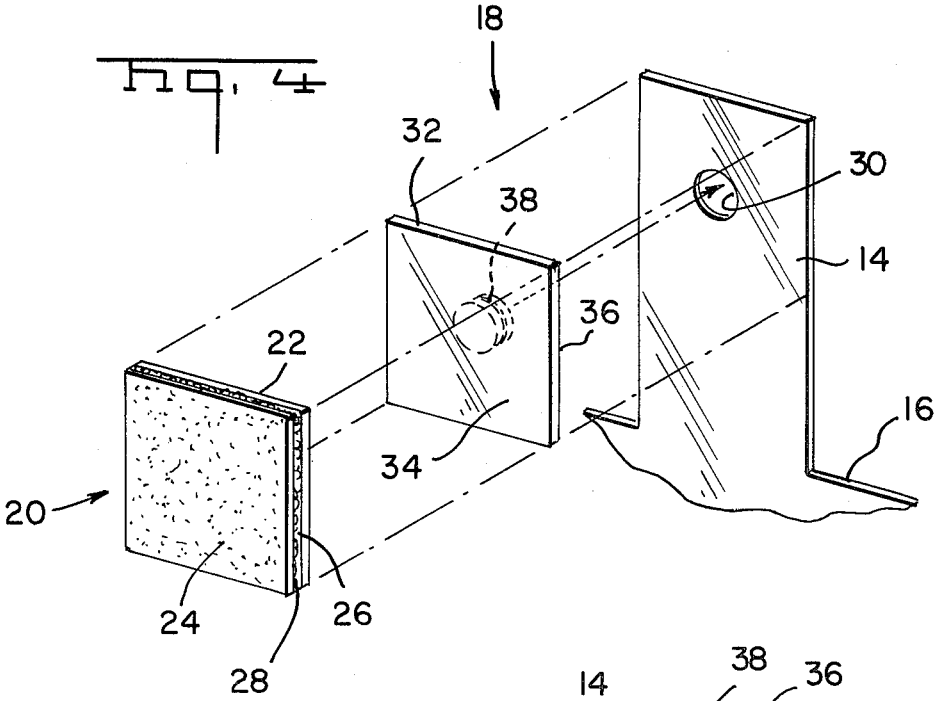
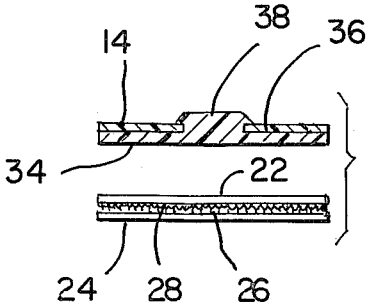
Fig. 5

MEANS FOR MOUNTING MEMBRANE SWITCHES TO CATHODE RAY TUBES

FIELD OF THE INVENTION

This invention relates to membrane switches of the type that are used on cathode ray tubes.

BACKGROUND OF THE INVENTION

In today's technological world, there is an increasing need for membrane switches that can be mounted on cathode ray tubes (CRT's). An ever increasing amount of software is becoming available that requires the user to answer questions by pressing appropriate areas of a CRT equipped with a membrane switch.

Membrane switches were initially developed for use in such items as calculators, computer keyboards, cash registers, games and the like. In manufacturing these items, the membrane switches are essential to the operation of the device. Housings for the items had to be developed to encase the switches.

A membrane switch used on a CRT, however, is an optional piece of equipment. The CRT can be fully operational without the membrane switch. The switch must be designed to fit an existing object. Mounting the switches to CRT's therefore presents unique problems.

Mounting is a particular problem with switches made from successive layers of essentially transparent film. It is essential that the film be held securely in place against the firm surface of the CRT. It is desirable that the means for mounting the switch not block any of the operable area of the switch. Furthermore, the method of mounting should permit realignment of the switch should the switch become distorted during use and easy replacement should the switch become damaged.

Heretofore, membrane switches for CRT's have been profiled to the shape of a CRT. The methods used for mounting these switches include the use of adhesive gaskets to adhere the switch to the face of the CRT and the use of brackets to surround a portion, or all, of the outer perimeter of the switch and a portion of the face of the CRT. There are problems associated with the above methods, particularly in aligning and replacement of the switch.

The disclosed invention solves the problems associated with mounting membrane switches on CRT's. An essential part of the means for mounting, integral with the switch itself, eliminates the use of gaskets and brackets. The means for mounting is comprised of a plurality of extensions of film along the perimeter of at least one layer of the film and a plurality of coupled fastening assemblies. The assemblies are comprised of two separable parts, the inner surfaces of which have a very large number of closely spaced hooking elements of the hook and loop type that engage with each other when the two parts are pressed together. One outer surface of the assembly is adhered to the film extensions and the second outer surface is fastened to the sides of the CRT. The fastening assemblies hold the switch securely to the CRT without blocking any of the face of the CRT, and at the same time permit easy realignment if the film becomes distorted during use. Furthermore, the switch can be removed and replaced with a minimum of effort.

DESCRIPTION OF THE DRAWINGS

FIG. 3 is an exploded view of one embodiment of the mounting means.

FIG. 4 is an exploded view of an alternative embodiment of the mounting means.

FIG. 5 is a side view of the embodiment shown in FIG. 4.

PREFERRED EMBODIMENT OF THE INVENTION

Figures 1, 2:
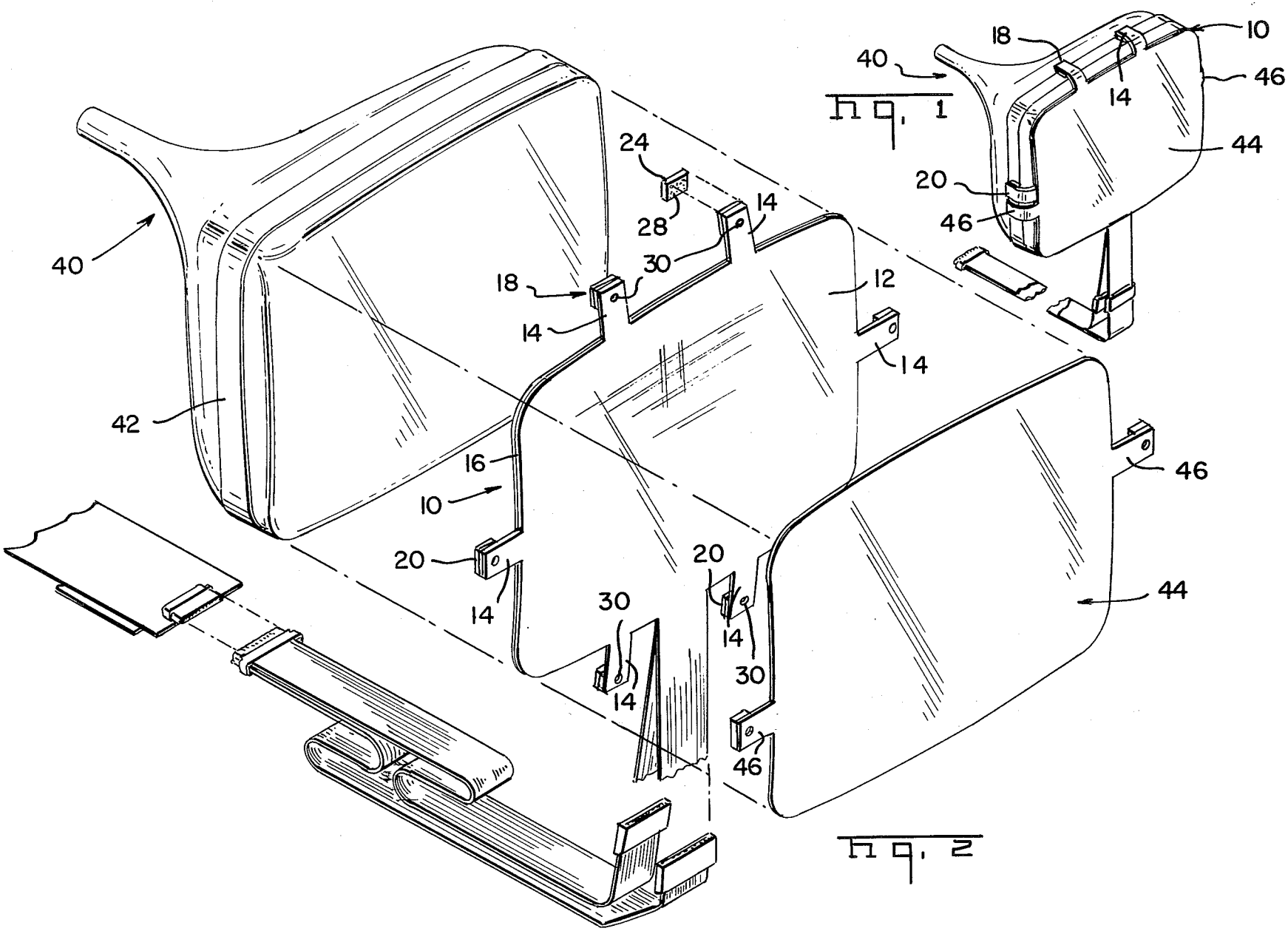
FIG. 1 is a three dimensional view of the preferred embodiment of the membrane switch assembly having mounting means and a filter having similar mounting means, mounted on a cathode ray tube.
FIG. 2 is an exploded view of the devices shown in FIG. 1.

Referring to FIGS. 1 and 2, a membrane switch assembly 10 having mounting means 18 is intended for mounting on a CRT 40. These figures also illustrate the use of a filter 44 disposed over the external surface 12 of the assembly.

Referring now to FIGS. 2 and 3, the mounting means 18 is comprised of extensions 14 which protrude from the outer perimeter 16 of the membrane switch and coupled fastening assemblies 20 having two outer surfaces 22 and 24, the first outer surface 22 for attaching to extension 14 and the second outer surface 24 for attaching to the sides of the CRT. The inner surfaces 26 and 28 have a very large number of closely spaced hooking elements of the hook and loop type that engage with each other when the two parts are pressed together.

FIG. 3 is an exploded view illustrating the mounting means 18, comprised of extension 14 and coupled fastening assembly 20 where surface 22 of the assembly 20 is adhered directly to the extension 14.

FIGS. 4 and 5 show an alternative embodiment of the mounting means 18. In this embodiment, extension 14 has an opening 30. Surface 22, of the coupled fastening assembly 20 is mounted to the first side 34 of a snap-in plate 32. The plate has a boss 38 extending from the opposite side 36. The boss 38 then snaps into the extension opening 30.

FIGS. 1 and 2 illustrate the use of the same type of mounting means as 18 for attaching the filter 44 to sides 42 of the CRT. The extensions 46 on the filter 44 are offset from extensions 14 on the switch for purposes of mounting.

The invention is intended for use with membrane switches comprised of two layers of film having conductors deposited on their internal surfaces, the internal surfaces being separated by an insulating spacer containing openings for switch sites.

In the preferred embodiment, extensions of film were profiled on both layers of film having conductors thereon. In practicing the invention, however, it is only necessary that at least one layer of film have extensions protruding therefrom. The extensions are of sufficient length to wrap around the perimeter of the CRT and be mounted on the tension band of the CRT.

Coupled fastening assemblies were adhered to the extensions after the switch had been formed and assembled. In the preferred embodiment, fastening assemblies having a pressure sensitive adhesive backing protected by release liners were used. Assemblies without the adhesive backing and a separate adhesive can also be used. Fastening assemblies of the type used are available from Velcro, USA, Inc., New York, N.Y. 10022 and from Minnesota Mining and Manufacturing Co., St. Paul, Minn. 55101.

In mounting the switches to a CRT, the CRT is removed from the housing. The switch is aligned in its proper place, release liner is removed from the second side of the fastening assembly and the assembly is adhered to the side of the CRT. The film extensions being thin do not interfere when the housing is replaced.

The switch can be removed from the CRT, if necessary, by separating the individual coupled fastening assemblies. Furthermore, this invention permits easy realignment of the switch should the film stretch after prolonged use and owing to the heat generated by the CRT, no longer lay flat against the CRT.

It is often desirable to use filters with membrane switches mounted on CRT's to reduce glare and to protect the surface of the switches. Filters can be profiled and mounted according to the invention. The extensions on the filter are offset from those of the switch for ease in mounting. This permits easy replacement of filters should they become scratched or otherwise unusable.

An alternative embodiment of the invention is shown in FIGS. 4 and 5. This embodiment permits the customer to snap in the fastener at the time the switch is ready for mounting on a CRT. Use of this embodiment eliminates bulk at the outer edges of the membrane switches, thus enabling the switches to be packaged closer together during shipping.

What is claimed is:

1. A membrane switch having mounting means for mounting the switch to a cathode ray tube, the switch comprised of two layers of substantially transparent film having internal surfaces that are separated from each other by spacing means, the spacing means having openings therein constituting switch sites, the internal surfaces of each layer having conductors thereon, the conductors crossing and being normally spaced from each other at the switch sites, the mounting means being characterized in that:

a plurality of extensions protrude from the perimeter of at least one of the layers of film, a patch of a coupled fastening assembly is attached to each extension, the fastening assembly is comprised of two separable parts, the inner surfaces of which have a very large number of closely spaced hooking elements of the hook and loop type that engage with each other when the two parts are pressed together, whereby, when the switch is aligned against the CRT, the extensions wrap around the perimeter of the CRT enabling the outer surfaces of the coupled fastening assemblies to be attached to one or more sides of the CRT.

2. The mounting means as set forth in claim 1 wherein the coupled fastening assembly is adhesively attached to the layer extensions and the sides of the CRT.

3. The mounting means as set forth in claim 1 wherein the extensions have openings therein.

4. The mounting means as set forth in claim 3 wherein the coupled fastening assembly is attached to the extension by means of a snap-in plate, the plate having one side with a boss sized to snap into the openings in the extension and a second side for attaching to the coupled fastening assembly.

5. The switch having mounting means as set forth in claim 1 wherein the conductors are electrodeposited hairline conductors.

6. A membrane switch having mounting means as set forth in claim 5 mounted on a CRT.

7. The switch having mounting means as set forth in claim 1 wherein the conductors are lines of conductive ink.

8. A membrane switch having mounting means as set forth in claim 7 mounted on a CRT.

9. A membrane switch having a mounting means kit comprised of a membrane switch having two layers of substantially transparent film, with at least one layer having a plurality of extensions protruding from one or more sides of its perimeter, the internal surfaces of the layers being separated from each other by spacing means, the spacing means having openings therein constituting switch sites, the internal surfaces of each layer having conductors thereon, the conductors crossing and being normally spaced from each other at the switch sites, and a plurality of patches of coupled fastening assemblies comprised of two separable parts, the inner surfaces of which have a very large number of closely spaced hooking elements of the hook and loop type that engage with each other when the two parts are pressed together, one outer surface of the assembly being used to attach to each extension and the second outer surface being used to attach the extension to the sides of the CRT.

10. The membrane switch having mounting means as set forth in claim 9 wherein the coupled fastening assembly is adhesively attached to the layer extensions and the sides of the CRT.

11. The membrane switch having mounting means as set forth in claim 9 wherein the extensions have openings therein.

12. The membrane switch having mounting means as set forth in claim 9 wherein the coupled fastening assembly is attached to the extension by means of a snap-in plate, the plate having one side with a boss sized to snap into the openings in the extension and a second side for attaching to the coupled fastening assembly.

13. The membrane switch having mounting means as set forth in claim 9 wherein the conductors are electrodeposited hairline conductors.

14. The membrane switch having mounting means as set forth in claim 9 wherein the conductors are lines of conductive ink.

* * * * *